United States Patent [19]

Okamoto

[11] Patent Number: 4,920,384

[45] Date of Patent: Apr. 24, 1990

[54] COPYING MACHINE WITH AUTOMATIC DOCUMENT FEEDING MEANS

[75] Inventor: Yuji Okamoto, Nara, Japan

[73] Assignee: Sharp Kabushiki Kaisha, Osaka, Japan

[21] Appl. No.: 356,669

[22] Filed: May 18, 1989

Related U.S. Application Data

[63] Continuation of Ser. No. 240,392, Aug. 29, 1988, abandoned, which is a continuation of Ser. No. 131,343, Dec. 9, 1987, abandoned, which is a continuation of Ser. No. 895,991, Aug. 13, 1986, abandoned.

[30] Foreign Application Priority Data

Aug. 28, 1985 [JP] Japan ..... 60-190202

[51] Int. Cl.[5] ..... G03G 21/00; G03G 15/06

[52] U.S. Cl. ..... 355/311; 355/243

[58] Field of Search ..... 355/145 H, 243, 208, 355/308, 311

[56] References Cited

U.S. PATENT DOCUMENTS 4,277,163 7/1981 Ikesue et al. ..... 355/243
4,575,227 3/1986 Ito et al. ..... 355/243 X
4,576,472 3/1986 Ito et al. ..... 355/14 SH
4,585,332 4/1986 Shenoy ..... 355/14 SH
4,622,594 11/1986 Honjo et al. ..... 355/14 SH
4,647,188 3/1987 Komiya et al. ..... 355/243 X
4,647,189 3/1987 Fujiwara et al. ..... 355/243
4,669,858 6/1987 Ito et al. ..... 355/243

*Primary Examiner*—A. T. Grimley
*Assistant Examiner*—E. Pipala
*Attorney, Agent, or Firm*—Flehr, Hohbach, Test, Albritton & Herbert

[57] ABSTRACT

A copying machine with automatic document feeder has two document size detectors. On detects document size by means of sensors when the document is on a document carrying table before it is transported by a feeding apparatus to a copying position. The other detects at least the length of the document in the direction of its motion. If different sizes are detected by the two detectors, the size of copy paper and magnification to be used in the copying are determined on the basis of the document size detected by the latter detector. With a feeder of this invention, document size can be detected accurately and efficiently.

12 Claims, 5 Drawing Sheets

COPYING MACHINE WITH AUTOMATIC DOCUMENT FEEDING MEANS

This is a continuation of application Ser. No. 240,392 filed Aug. 29, 1988, to be abandoned, which is a continuation of application Ser. No. 131,343 filed Dec. 9, 1987, now abandoned, which is a continuation of application Ser. No. 895,991 filed Aug. 13, 1986, now abandoned.

BACKGROUND OF THE INVENTION

This invention relates to a copying machine with automatic document feeding means and more particularly to a copying machine having an automatic document feeder which automatically detects the document size.

According to a previously considered method of detecting the size of a document to be copied by a copying machine, a plurality of sensors are provided on the document carrying table to detect both the longitudinal and transverse dimensions of the document. Another method has been to determine the size on the basis of the distance traveled by the document as it is transported to a copying position. The former method is disadvantageous, for example, when documents of different sizes are piled on the table because only the size of the largest document is detected and smaller documents may be copied on a disproportionately large copy paper. In other words, the operator will have to prearrange the documents to be copied in such a way that documents of the same size lie together. The latter method is disadvantageous because the selection of copy paper size and adjustment of magnification by moving a lens, for example, must be effected each time a new document is transported. Adjustments of such conditions for copying operation are time-consuming and this method can defeat the very purpose of using an automatic document feeder to shorten the time required for making copies.

SUMMARY OF THE INVENTION

It is therefore an object of the present invention in view of the above to provide a copying machine with an improved automatic document feeding means such that even if documents of different sizes are placed on its document carrying table, the size of each document can be accurately detected for proper selection of the size of copy paper and magnification and also that the copying operation can be effected speedily if the arrangement of documents on the table satisfies a certain condition.

Explained briefly, there are provided for the purpose of detecting a document size according to the present invention a first detector means for detecting a document size on the basis of outputs from a plurality of sensors which are set on the document carrying table of an automatic document feeder and a second detector means for detecting at least the dimension of the document in the direction in which it is transported such that conditions for the copying operation such as the size of the copy paper to be used and the magnification in the copying are set on the basis of the document size determined by the second detector means if the two detector means detect different sizes. Even if documents of different sizes are piled one on top of another on the document carrying table of the automatic document feeder, the copying machine according to the present invention detects at least the length of the document in the feeding direction when it is being transported, and if it is different from the document size detected by the sensors on the document carrying table, the conditions for the copying operation are set on the basis of the result obtained by the second detector means. Thus, each document can be copied under conditions specifically set for it, but if the newly supplied document is found to be of the same size detected previously by the sensors on the document carrying table, time required for starting the next copying operation can be shortened and hence the copying machine can be operated in a more efficient manner.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
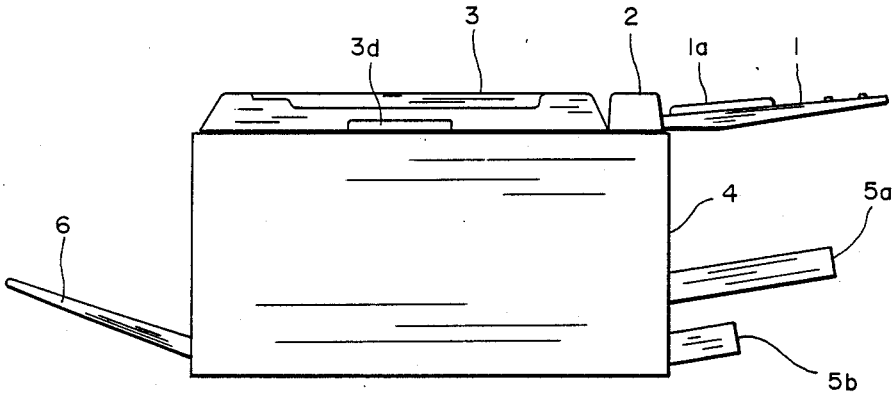
FIG. 1 is an external front view of a copying machine with automatic document feeding means which embodies the present invention.

With reference to FIG. 1 which is an external front view of a copying machine embodying the present invention, a document carrying table 1, a document feeding unit 2 and a document supply unit 3 essentially constitute its document feeder. If a plurality of documents to be copied are placed on the document carrying table 1 and a start key (not shown) is operated to start the operation, the document feeding unit 2 begins to transport the document at the top of the pile on the document carrying table 1 to the document supply unit 3. The document supply unit 3 serves to transport a document sent from the document feeding unit 2 to a specified position and then stops. A copy paper of selected size is supplied from one of cassettes 5*a* and 5*b* according to the document size detected by sensors set on the document carrying table 1 or in the document supply unit 3, desired magnification, etc. After the completion of a copying operation, copy paper is discharged into a discharge tray 6.

Figure 2:
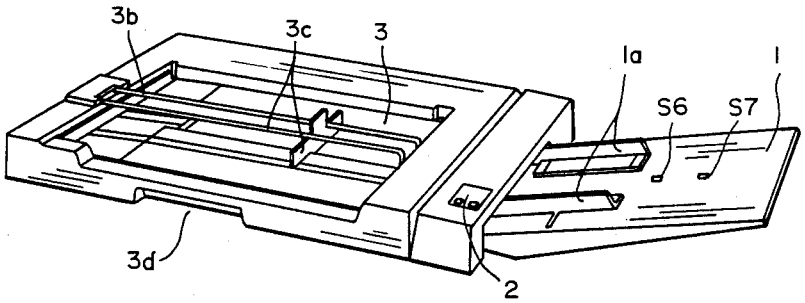
FIG. 2 is an external diagonal view of the automatic document feeder shown in FIG. 1.
Figure 3:
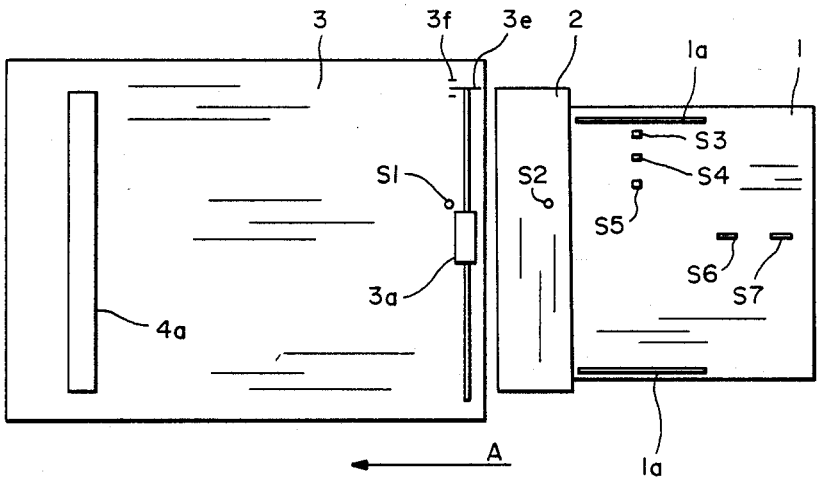
FIG. 3 is a plan view of the copying machine of FIG. 1.

With reference next to FIG. 2 which is an external diagonal view of the aforementioned automatic document feeder and FIG. 3 which is its plan view, two guide plates 1*a* are provided on the document carrying table 1 so that documents can be piled up at the center section of the table. The interval between the guide plates 1*a* can be adjusted manually according to the width of the document. Three width sensors S3, S4 and S5 are provided, spaced transversely with respect to the direction in which documents are transported. Together, they serve to detect the width of the document on the document carrying table 1. Length sensors S6 and S7, on the other hand, are spaced longitudinally and serve likewise to detect the size of the document in the direction in which it is transported. After a copying process is completed, the copied document is discharged through a document discharging section 3*b* of the document supply unit 3 and stops when it hits a document stopper 3*c*. The document supply unit 3 is also provided with a handle 3*d* by means of which it can be opened upward. If the document supply unit 3 is opened thus, it becomes possible to place a document directly at the copying position on the upper surface of the copying machine.

The aforementioned width sensors S3–S5 are all situated below the surface of the document carrying table 1. The document feeding unit 2 contains rollers (not shown) for providing motion to documents and a documents sensor S2 for determining whether there is a document in contact with these rollers. In other words, presence or absence of documents on the document carrying table 1 is detected by means of this document sensor S2. A feeder roller 3*a* is disposed inside the document supply unit 3 adjacent to the document feeding unit 2. Documents on the table 1 are transported by means of this roller 3*a* in the direction of the arrow A and there is provided a passage sensor S1 in this neighborhood for the purpose of detecting the passage of a document. A pulse disk 3*e* is provided on the shaft of the feeder roller 3*a* and there is further provided a pulse sensor 3*f* for detecting the pulse. After the passage sensor S1 detects a document, the pulse sensor 3*f* begins to count the pulses of the pulse disk 3*e* such that the number of pulses which has been counted by the time the passage sensor S1 detects the passing of the document represents the length of the document which has passed.

At the downstream end (at left in FIG. 3) on the top surface of the copying machine main body (below the automatic document feeder) there is a document stopper 4*a*. Documents which are transported by a conveyor belt (not shown) disposed inside the document supply unit 3 are stopped by this stopper 4*a* at a position determined thereby. Copied documents can be taken out through the aforementioned document discharging section by releasing this stopper 4*a* and moving the belt. Although the feeder roller 3*a*, the pulse disk 3*e*, the pulse sensor 3*f* and the passage sensor S1 are shown in FIG. 3 by solid lines for the convenience of illustration, it should be understood that they are actually disposed inside the automatic document feeder. In summary, a feeder with the structure disclosed above enables one to detect the size of a document not only while it is placed on the document carrying table but also while it is being transported.

Figure 4:
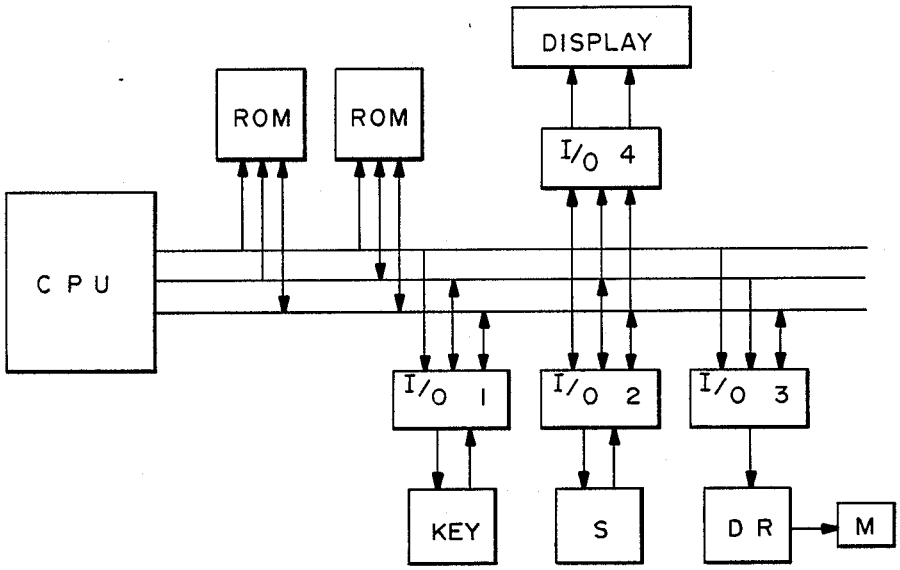
FIG. 4 is a block diagram of the control section of the copying machine of FIG. 1, FIGS. 5, 6A, 6B, 6C, 6D and 6E are flow charts showing the operation of the central processing unit (CPU) in the control section shown in FIG. 4.
Figure 7:
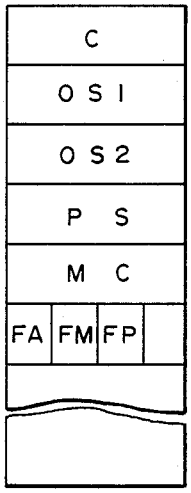
FIG. 7 is a diagram showing the memory map of the RAM in the control section shown in FIG. 4.
Figure 6E:
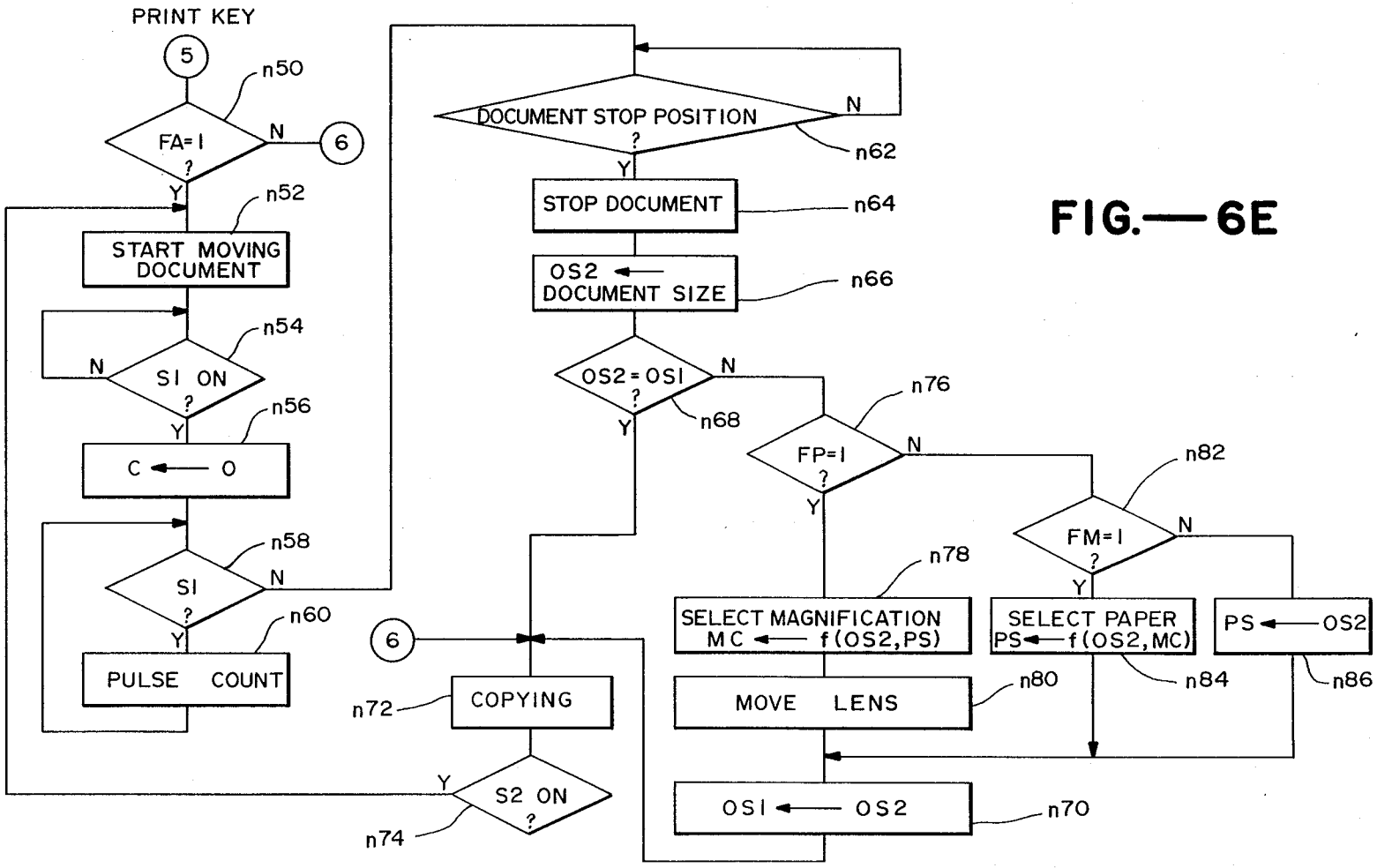

A control unit for the copying machine described above is explained next by way of the block diagram in FIG. 4. CPU therein represents a control circuit including a microprocessor and performs processing according to a preset program in a ROM means (ROM). RAM represents a memory means to be used as a working area when this program is executed. The control unit further includes a first input/output circuit I/O1 through which CPU reads the status of a key input means KEY, a second input/output circuit I/O2 for reading the conditions of the various sensors described above, a third input/output circuit I/O3 for controlling a driving circuit DR for controlling motors M for various driving means such as the document feeder roller 3*a*, and a fourth input/output circuit I/O4 related to a display means (DISPLAY) for displaying document size, copy paper size, magnification, etc. FIG. 7 shows a memory map of the RAM. Symbols therein are the same as those used in the flow charts of FIGS. 5 and 6, and are explained below.

Figure 5:
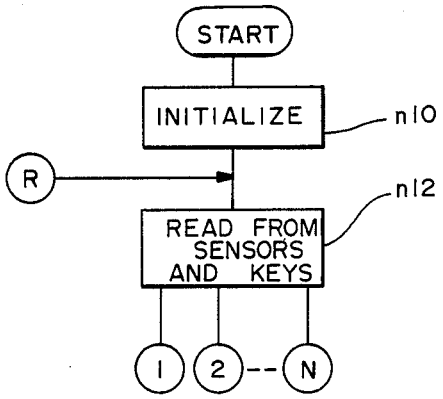
Figure 6A:
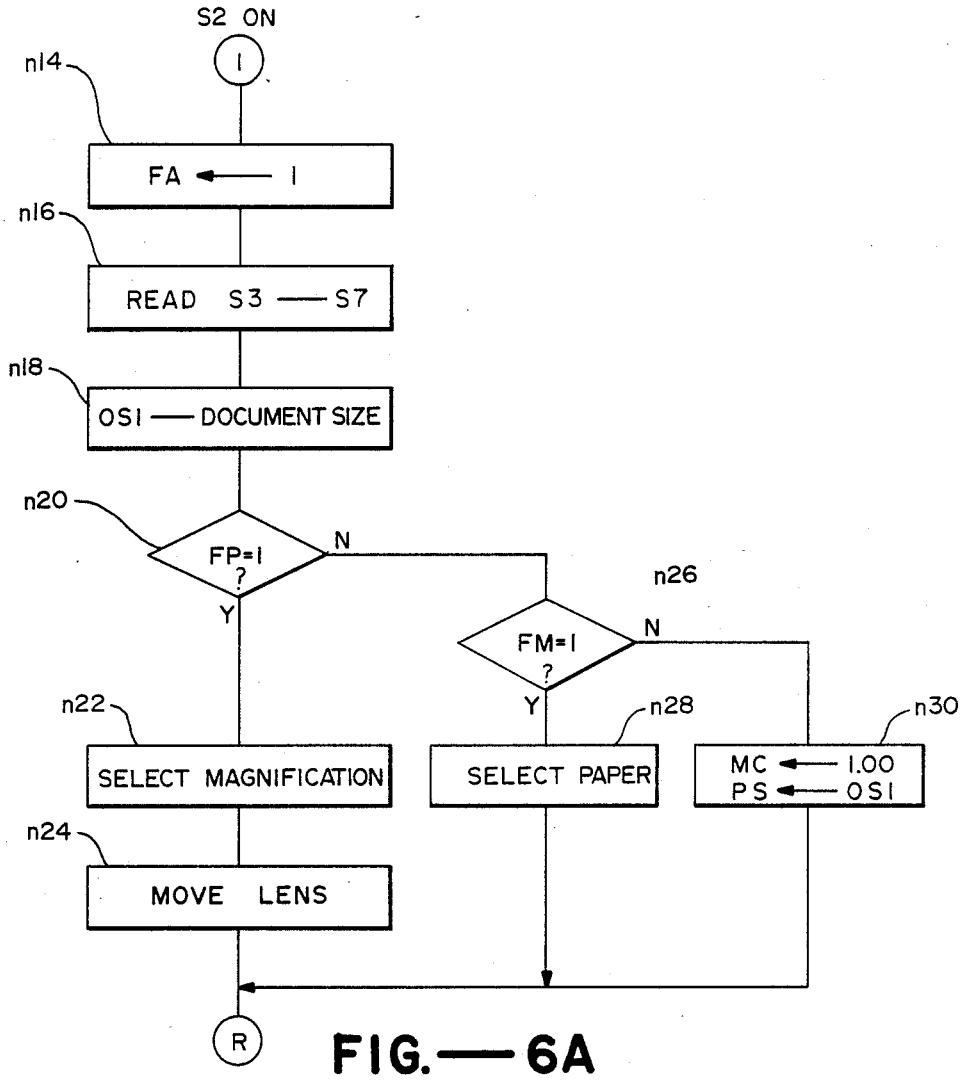
Figure 6B:
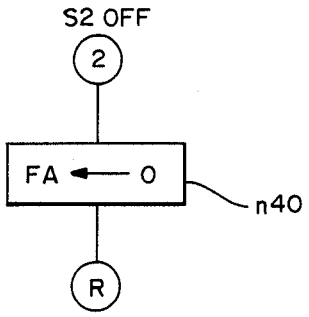
Figure 6C:
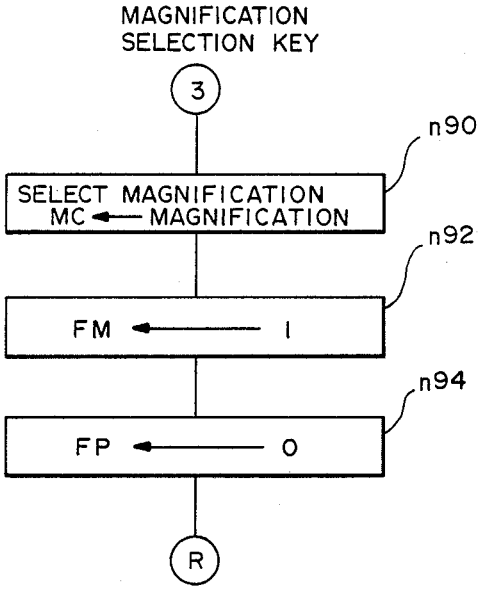
Figure 6D:
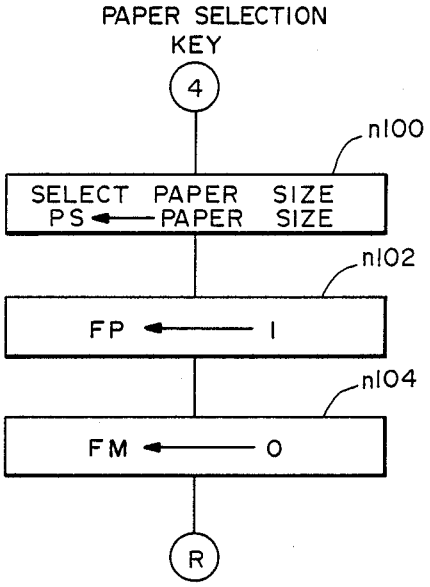

When power is switched on, each part of the copying machine is initialized (n10 of FIG. 5). This includes the warming up of the roller for fixing images. Thereafter, data from the key input means and the sensors are inputted (n12). The subsequent operations are carried out according to the data inputted in this step.

If the document sensor S2 is ON, for example, a flag FA is set (n14 of FIG. 6-A) to indicate the condition of documents on the document carrying table. Thereafter, the conditions of the widths and length sensors S3–S7 are inputted (n16), the size of documents on the document carrying table is detected and the detected size is inputted to a buffer OS1 (n18). If the size of copy paper and magnification are not set at this point, both flags FP and FM are in reset condition (FP=FM=0, and hence NO in both n20 and n26). Then, 1.00 is inputted to a buffer MC which stores magnification and the content of the buffer OS1 representing the document size is copied into a buffer PS which stores the size of copy paper (n30). At this moment, the copying machine is ready to make a copy with magnification 1 on the paper with the size equal to the detected size of the document to be copied from. If a print key (not shown) is pressed at this moment, the control unit first recognizes that the flag FA is set (n50 of FIG. 6-E) and begins to supply a document (n52). Thereafter, when the document reaches the position of the passage sensor S1 (YES in n54), a counter C is reset (n56). From this time on, the counter C continues to count output signals from the pulse sensor 3*f* shown in FIG. 3 until the passage sensor S1 stops detecting the document (n58 to n60). When it is detected that the document has reached a predetermined position (n62), the document is stopped at this position (n64) and the length of the document detected on the basis of the value of the counter C is inputted to buffer OS2 (n66).

The size of the document thus determined is then compared with the size which was determined by the sensors on the document carrying table as explained above by way of FIG. 6-A and is now stored in buffer OS1 (n68). If they match, copying is effected with the conditions already set regarding the copy paper size and magnification (n72). In other words, if the size of a newly supplied document is the same as that of the preceding document which has just been measured on the document carrying table, the next copying operation can be started immediately as soon as the next document reaches the aforementioned predetermined position without the necessity of moving the lens to change the magnification for copying.

The document sensor S2 is examined next (n74) and if it is ON, it means that there is still a document to be copied and such document is transported for copying (n52). After all documents have been processed (NO in n74), the control program goes back to Step n12 of FIG. 5 to input another command.

If the document size detected by the passage sensor S1 when the document is transported does not match the size detected on the basis of outputs from the sensors on the document carrying table (NO in n68), the content of the buffer OS2 representing the document size based on the passage sensor S1 is copied into the buffer PS for storing paper size (n86) because the flags FP and FM are both in reset condition. The content of OS2 is temporarily stored in the buffer OS1 (n70) and copying is effected (n72) on a copy paper of the size specified by the buffer PS.

If a key for selecting magnification (not shown and referred to for convenience as the magnification selection key in FIG. 6-C) is operated, one of a plurality of preselected magnifications is chosen and inputted to the buffer MC (n90) as shown in FIG. 6-C. A group of such preselected magnifications is already stored in the form of a table inside the ROM and the contents of this table are sequentially called out when the magnification selection key is operated. Thereafter, the flag FM is set (n92) to indicate that a magnification has been selected and that the program is now operating in what will be referred to as the magnification priority mode.

The flag FP is for indicating that the program is operating in what may be referred to below as the paper size priority mode. It is set when the size of copy paper has been selected. If a key for selecting the size of copy paper (not shown and referred to for convenience as the paper selection key in FIG. 6-D) is pressed, a plurality of preselected paper sizes are sequentially read from the memory and one of them which is selected is inputted to the buffer PS (n100) as shown in FIG. 6-D. Thereafter, the flag FP for indicating the paper size priority mode is set (n102) and the flag FM for indicating the magnification priority mode is reset (n104).

If a document is placed on the document carrying table when the program is in the paper size priority mode, the document sensor S2 becomes ON, and the detected document size is inputted to OS1 (n18) as shown in FIG. 6-A. A specific one of preselected magnifications is determined on the basis of both this document size and the content of PS which has already been set and it is inputted to MC (n22). The lens for determining magnification is moved according to this new content of the buffer MC to prepare for copying operation. If the print key is operated thereafter, the document is moved (n52) as shown in FIG. 6-E and the size of this document is detected at the same time and inputted to OS2 (n66), but if this detected size does not match the previously detected size stored in OS1 (NO in n68), a new magnification is determined on the basis of the contents of OS2 and PS (n80).

If a document is placed on the document carrying table when the program is in the magnification priority mode (YES in N26), on the other hand, paper size PS is determined on the basis of the document size stored in OS1 and the content of MC indicating the magnification which has been set (n28). If the print key is operated thereafter, the document is moved (n52) as shown in FIG. 6-E, but if the document size detected at this time and inputted to OS2 (n66) is different from the content of OS1 (NO in n68), a new paper size to be inputted to PS is determined on the basis of OS2 and the content of MC (n84).

When two or more documents are piled on the document carrying table and sequentially transported, the size of a later fed document is always compared with that of a previously fed document detected while it was being transported. In other words, at Step n70 of FIG. 6-E, the buffer OS1 does not function as the buffer for the document size detected on the document carrying table but stores the content of OS2 representing the document size set in Step n66 and is used for comparison with the document size which will be detected when the next document is transported. When documents of the same size are repeatedly transported, therefore, neither magnification nor paper size needs to be changed. The time between the feeding of a document and the start of copying can thus be shortened because the program proceeds directly from Step n68 to Step n72.

If there is no document on the document carrying table, the flag FA is in a reset condition as shown in FIG. 6-B. If the print key is pressed under this condition, copying takes place without any document being transported (from Step n50 directly to Step n72).

The foregoing description of a preferred embodiment of the present invention has been presented for purposes of illustration and description. It is not intended to be exhaustive or to limit the invention to the precise form disclosed, and obviously many modifications and variations are possible in light of the above teaching. Such modifications and variations which may be apparent to a person skilled in the art are intended to be included within the scope of this invention.

What is claimed is:

1. A copying machine with automatic document feeding means, said copying machine being operable selectably in a magnification priority mode of operation wherein said copying machine is operated at a specified magnification and in a paper size priority mode of operation wherein a copy is produced on a paper sheet of a specified size, said copying machine comprising a document carrying table for placing documents thereon, a document transportation means for sequentially and automatically transporting documents in a specified direction from said document carrying table, and document size detecting means for detecting the size of said documents, said document size detecting means including, a first detector means for detecting the size of a stationary document by a plurality of sensors disposed on said document carrying table, a second detector means for detecting at least the length of a document along said specified direction as said document is transported in said specified direction by said document transporting means, and a control means for comparing document sizes detected by said first and second detecting means and selecting a magnification value in said paper size priority mode and a copy paper size in said magnification priority mode of operation of said copying machine on the basis of document size detected by said second detecting means if document sizes detected by said first and second detecting means do not match.

2. The copying machine of claim 1 wherein said second detector means detects the length of a document being transported by measuring the time required for said document to pass a predetermined position.

3. The copying machine of claim 1 wherein said sensors are spaced both longitudinally and transversely with respect to said specified direction.

4. The copying machine of claim 1 wherein said second detector means includes a single sensor disposed on a passageway on which said document transporting means transport documents in said specified direction.

5. The copying machine of claim 1 wherein said control means include a microprocessor and memory means.

6. The copying machine of claim 5 wherein said memory means store a plurality of preselected paper sizes.

7. A copying machine with automatic document feeding means comprising a document carrying table for placing documents thereon, a document transportation means for sequentially and automatically transporting documents in a specified direction from said document carrying table, and document size detecting means for detecting the size of said documents, said document size detecting means including, a first detector means for detecting the size of a stationary document by a plurality of sensors disposed on said document carrying table, a second detector means for detecting at least the length of a document along said specified direction as said document is transported in said specified direction by said document transporting means, and a control means for comparing document sizes detected by said first and second detecting means and setting conditions for copying operation of said copying machine on the basis of document size detected by said second detecting means if document sizes detected by said first and second detecting means do not match.

8. The copying machine of claim 7 wherein said second detector means detects the length of a document being transported by measuring the time required for said document to pass a predetermined position.

9. The copying machine of claim 7 wherein said sensors are spaced both longitudinally and transversely with respect to said specified direction.

10. The copying machine of claim 7 wherein said second detector means includes a single sensor disposed on a passageway on which said document transporting means transport documents in said specified direction.

11. The copying machine of claim 7 wherein said control means include a microprocessor and memory means.

12. The copying machine of claim 11 wherein said memory means store a plurality of preselected paper sizes.

* * * * *